US005632692A

United States Patent [19]

Lebovici

[11] Patent Number: 5,632,692

[45] Date of Patent: May 27, 1997

[54] GOLF CLUB WITH NON-CIRCULAR SHAFT

[76] Inventor: Victor B. Lebovici, 29 Farmington Rd., West Newton, Mass. 02165

[21] Appl. No.: 536,617

[22] Filed: Sep. 28, 1995

[51] Int. Cl.[6] ..... A63B 53/10

[52] U.S. Cl. ..... 473/317; 473/319; 273/DIG. 23

[58] Field of Search ..... 273/80 R, 80 B, 273/80.1, 80.2, 80.8, 80.9, 167 E, DIG. 7, DIG. 23; 473/305–323

[56] References Cited

U.S. PATENT DOCUMENTS

| | | | |
|---|---|---|---|
| 1,239,356 | 9/1917 | Cochrane | 273/80.9 |
| 1,787,415 | 12/1930 | Washington | 273/80.8 |
| 2,018,723 | 10/1935 | Hutchison | 273/80.2 |
| 2,027,635 | 1/1936 | Cunningham | 273/80.2 |
| 2,150,737 | 3/1939 | Chittick | 273/80.2 |
| 3,661,388 | 5/1972 | Leslie . | |
| 4,132,579 | 1/1979 | Van Auken | 273/DIG. 23 |
| 4,763,899 | 8/1988 | Hundley . | |
| 5,054,781 | 10/1991 | Soong . | |
| 5,093,162 | 3/1992 | Fenton et al. . | |

FOREIGN PATENT DOCUMENTS

| | | | |
|---|---|---|---|
| 800882 | 7/1936 | France | 273/80 R |
| 10431 | of 1906 | United Kingdom | 273/80 R |
| 20882 | of 1909 | United Kingdom | 273/80 R |
| 442557 | 2/1936 | United Kingdom | 273/80 R |
| 489638 | 10/1936 | United Kingdom | 273/80 R |
| 477647 | 1/1938 | United Kingdom | 273/80 R |
| 518699 | 3/1940 | United Kingdom | 273/80 B |
| 523647 | 7/1940 | United Kingdom | 273/80 R |
| 1159714 | 7/1969 | United Kingdom | 273/80 B |

OTHER PUBLICATIONS

"Taylor Made", Taylor Made Golf Company 1994 Brochure.

*Primary Examiner*—Sebastiano Passaniti

*Attorney, Agent, or Firm*—Weingarten, Schurgin, Gagnebin & Hayes LLP

[57] ABSTRACT

An improved golf club includes a shaft having a noncircular cross section along at least a portion thereof and a club head. The shaft provides increased rigidity in a direction transverse to intended ball impact and a desirable flex characteristic in the direction of intended ball impact. The noncircular cross section of the shaft has a first a dimension in the direction of ball impact and a second dimension transverse to the direction of ball impact. Greater flexibility of the shaft in the direction of ball impact than in the direction transverse to the direction of ball impact is assured by making the first dimension of the shaft cross section smaller than the second dimension. To provide greater flexibility of the shaft in the vicinity of the club head, the shaft may be tapered.

4 Claims, 5 Drawing Sheets

GOLF CLUB WITH NON-CIRCULAR SHAFT

FIELD OF THE INVENTION

The present invention relates to sporting equipment and more particularly to golf clubs.

BACKGROUND OF THE INVENTION

It is well known that the distance that a golf ball travels when struck with the club head of a golf club is a function of club head speed. Golf club shafts are typically made of thin walled metal tubing or fiber reinforced plastics and composites. Prior art shafts are typically fabricated of steel or composite materials such as graphite and are typically tapered so as to have a larger circular cross section near the handle end of the shaft than at the shaft end adjacent the club head.

In recent years, companies have manufactured golf clubs which have shafts fabricated of composite materials which are light yet strong and flexible. The flexibility of the shaft allows the shaft to bend during the swing. Such flexing of the shaft during the swing permits the club head to impact the ball with a higher velocity and thus propel the ball a greater distance. It is understood however, that a golf club shaft which is too flexible, can result in club head flutter during the swing. Such flutter makes it more difficult to strike the ball in the center of the club head. Additionally, twisting of the club head even a small amount can produce inaccurate shots. Such problems are particularly notable in the more flexible golf club shafts fabricated of composite materials such as graphite.

SUMMARY OF THE INVENTION

The presently described golf club includes a shaft having a grip receiving portion, a shaft mid-section and a hosel mounting portion. A grip is disposed over the grip receiving portion of the club and the hosel mounting portion of the shaft is mounted to the hosel of a golf club head. At least the mid-section of the presently described shaft has a non-circular cross section, with a first dimension (measured at the widest point) in the direction of ball impact and a second dimension (measured at the widest point) in the direction transverse to the direction of ball impact. The first dimension is less than the second dimension so that the shaft is more flexible in the direction of ball impact than in the direction transverse to ball impact. The cross section herein described extends at least from below the grip receiving portion to a point adjacent the hosel mounting portion near the lower end of the shaft and may extend the length of the shaft. Additionally, the shaft may be tapered so as to be of larger cross section in the region of the shaft mid-section adjacent the grip receiving portion than in the region of the mid-section adjacent the hosel mounting portion. In one embodiment the shaft has a cross section which is generally oval along a substantial portion of its length, with the smaller dimension of the oval oriented in the direction of ball travel. Any non-circular cross section may be employed which meets the above described criteria to provide a desired flex characteristic. The shaft having the presently disclosed cross section permits the golf ball to be impacted by the club head at a high club head velocity so as to achieve longer shots with both woods and irons while affording greater accuracy.

In a putter, in which increased stiffness is desirable, but flutter is not of concern, the shaft may have a non-circular cross section which is oriented such that the larger cross section dimension is in the direction of ball impact. A light but rigid shaft may thus be provided.

BRIEF DESCRIPTION OF THE DRAWINGS

The invention will be more fully understood by reference to the following description in conjunction with the accompanying drawings of which.

DETAILED DESCRIPTION OF THE DRAWINGS

Figure 1:
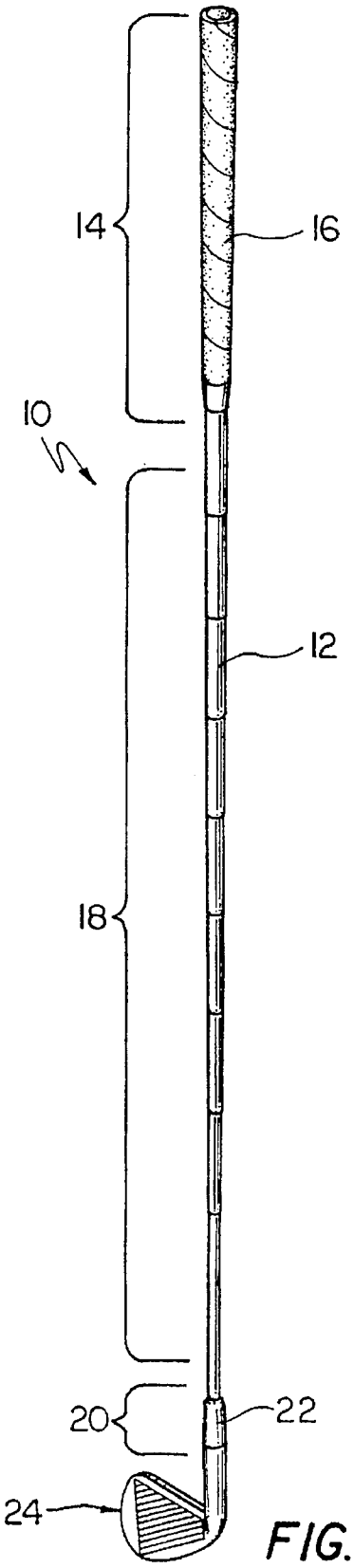
FIG. 1 PRIOR ART
FIG. 1 is a perspective view of a prior art golf club.

A prior art golf club, and in particular an iron 10 is shown in FIG. 1. The iron 10, includes a shaft 12 of circular cross section. The shaft includes an grip receiving portion 14 which receives a grip 16, a shaft mid-section 18 and a hosel mounting portion 20. The hosel mounting portion 20 is mounted to a hosel 22 of a club head 24 by affixing the hosel mounting portion of the shaft 12 to the hosel 22 of the club head 24. The hosel mounting portion may be cemented within a cavity disposed in the hosel via use of epoxy or any other suitable adhesive. Alternatively, the hosel mounting portion of the shaft may be mounted to the hosel via any other suitable mounting technique known in the art.

Figure 2:
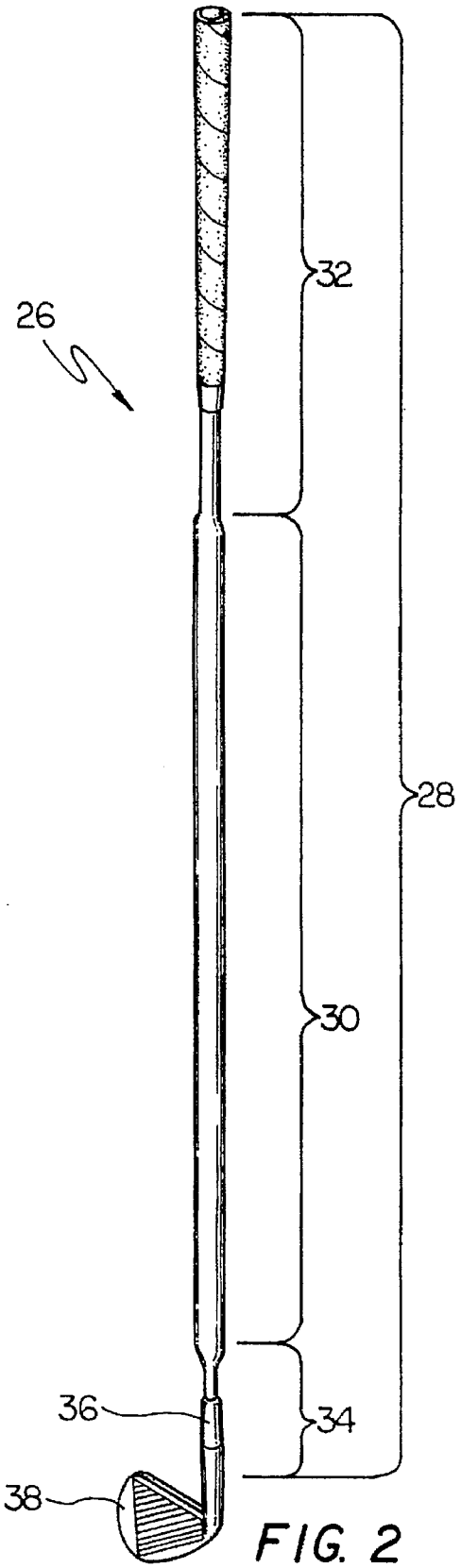
FIG. 2 is a perspective view of golf club of the type known as an "iron" in accordance with the present invention.
Figure 3:
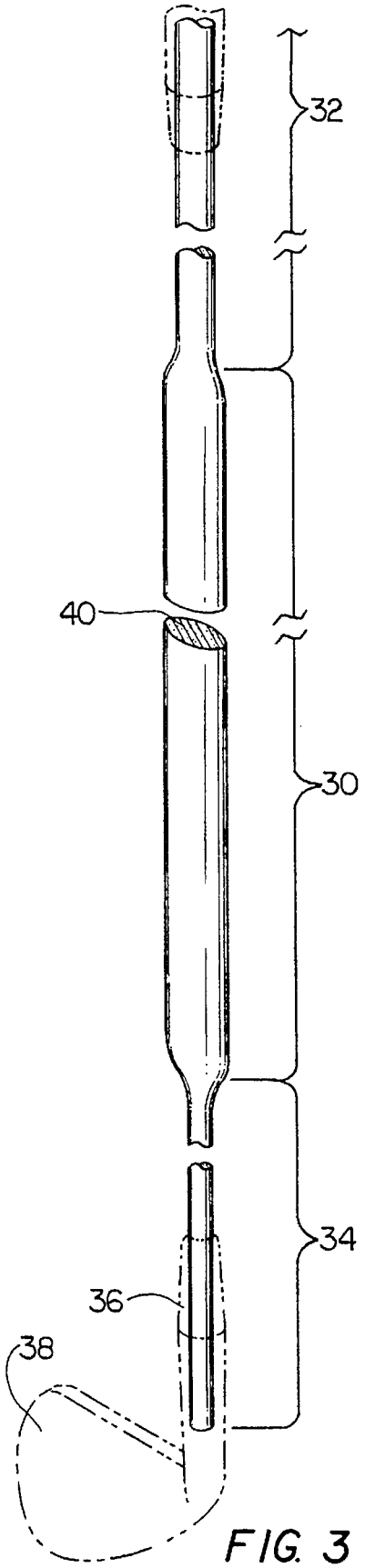
FIG. 3 is a perspective cut-away view of a golf club shaft in accordance with the invention having a generally oval or elliptical cross section along a substantial portion of the shaft.

Referring to FIGS. 2 and 3, the improved golf club 26 is intended for hitting a golf ball a considerable distance through the air. Although the golf club 26 is depicted as an iron, such may be either a wood or an iron (herein referred to as a "distance golf club"). The presently disclosed golf club 26 includes a shaft 28 which includes a mid-section 30, a grip receiving portion 32 and a hosel mounting portion 34. The grip mounting portion 32 receives a grip. The hosel mounting portion 34 is mounted to the hosel 36 of a club head 38 of an iron (depicted) or a wood (not shown) via any suitable mounting technique known in the art. It is recognized that the club head 38 of a "wood" may be fabricated of wood, metal, a composite material, ceramic or any other hard suitable material, or combinations of such materials.

The cross-section 40, in one embodiment, is generally oval or elliptical in shape.

Figure 4A:
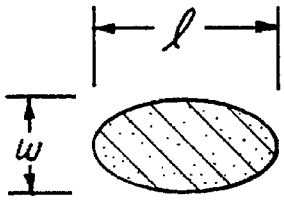
FIGS. 4*a* through 4*c* illustrate purely exemplary non-circular cross sections which may be employed for the mid-section of the shaft of FIG. 2.
Figure 4B:
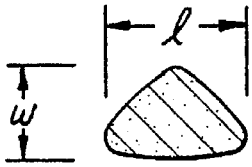
Figure 4C:
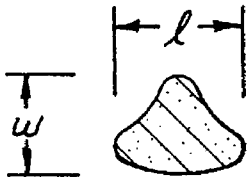

At least the mid-section 30 of the shaft 28 is provided with a non-circular cross section as illustrated in exemplary FIGS. 3A, 3B, 3C. In each case, the cross section of the mid-section of the shaft has a first dimension (w) in the direction of ball impact and a second dimension (l) in a direction transverse to ball impact and the second dimension is greater than the first dimension. FIG. 4A depicts one exemplary cross section for the mid-section 30 of the shaft 28 which is generally oval in shape, FIG. 4B and 4C depict other exemplary cross sections for the mid-section 30 of the shaft 28 having a generally triangular shape. The shaft may be oriented so as to present a tapered leading edge (top of cross section as depicted in FIGS. 4A and 4B) for the mid-section 30 of the shaft 28 to minimize air resistance during the club swing and thus facilitate a greater club head velocity upon ball impact.

Referring again to FIGS. 2 and 3, the grip receiving portion 32 may be provided with a generally circular cross section so as to be able to permit use of commercially available grips, or alternatively, the grip receiving portion 32 of the shaft 28 may have the cross section of the shaft 28 mid-section 30 or any other suitable cross section. In the event that the grip receiving portion 32 is provided with the same cross section as the mid-section 30, the golf club will require the use of a grip 36 specially adapted to be disposed over the grip receiving portion 32 of the shaft 28. The grip receiving portion 32 of the shaft 28 may have cross section dimensions greater than upper portion of the shaft mid-section 30, substantially equal to the dimensions of the upper portion of the shaft mid-section 30, or smaller than the upper portion of the shaft mid-section 30 (as depicted in FIG. 3.

Figure 5:
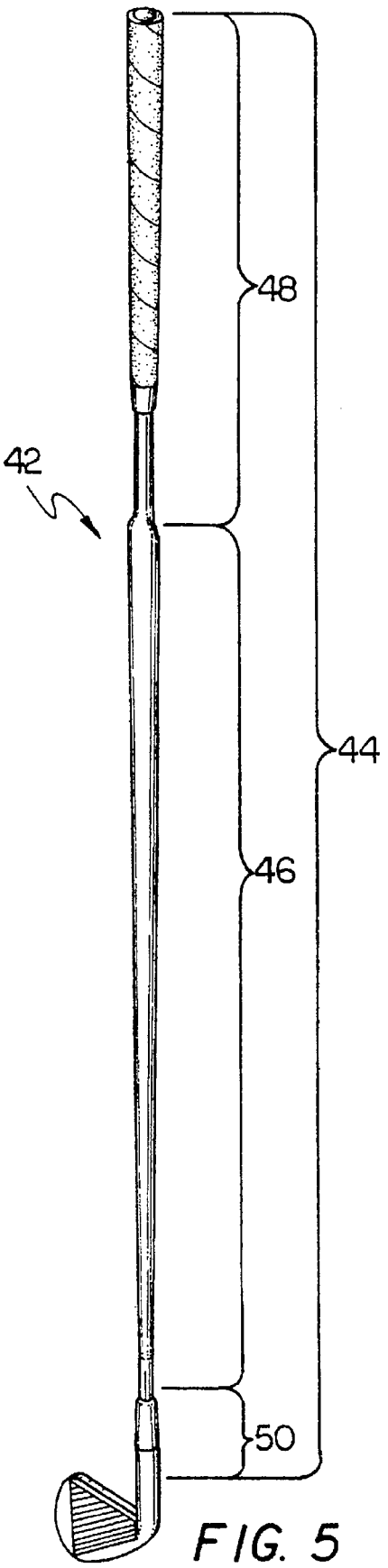
FIG. 5 is a perspective view of a golf club fabricated of a graphite composite which, in accordance with the present invention, has a shaft of non-circular cross section. The shaft is tapered from the upper mid-section of the shaft to the lower mid-section of the shaft.

As illustrated in FIG. 5, the golf club 42 has a shaft 44 fabricated of a composite material such as a graphite composite and a club head 54. The shaft 44 has a central portion or mid-section 46, a grip receiving portion 48 and a hosel mounting portion 50. At least the mid-section 46 of the shaft has a non-circular cross-section which is tapered from a mid-section region adjacent the grip receiving portion 48 to a mid-section region adjacent the hosel mounting portion 50. The hosel mounting portion 50 of the shaft 44 is mounted to the hosel 52 of the club head 54 via any conventional mounting technique. Such tapering of the mid-section provides for greater flex of the shaft 44 near the club head 54.

Figure 6:
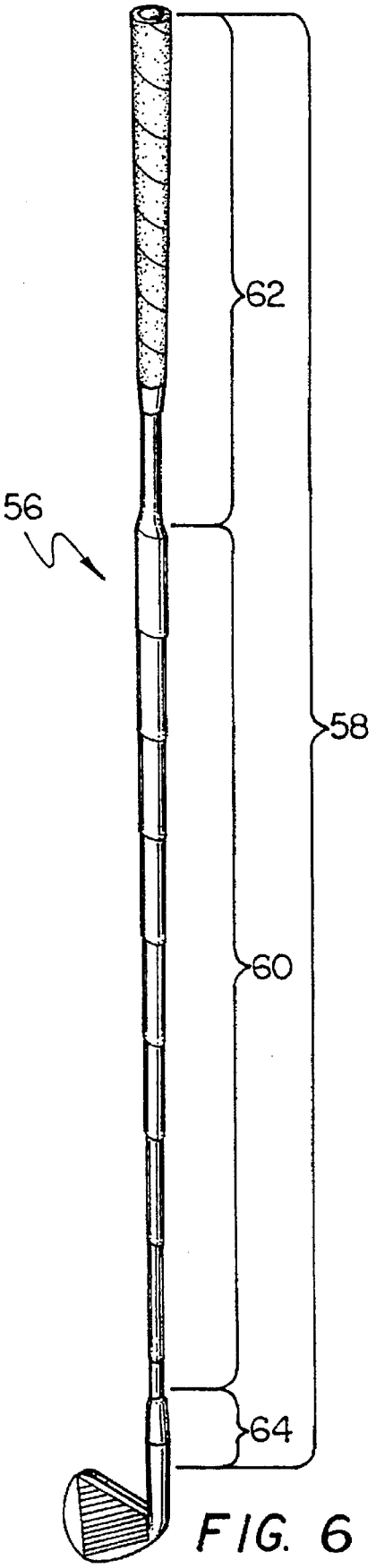
FIG. 6 is a perspective view of a golf club fabricated of metal tubing which, in accordance with the present invention, has a shaft of non-circular cross section. The shaft is tapered from the upper mid-section of the shaft to the lower mid-section of the shaft.

In another embodiment illustrated in FIG. 6, the golf club 56 has a shaft 58 fabricated of tubular steel. The shaft has a mid-section 60, a grip receiving portion 62 and a hosel mounting portion 64 and at least the mid-section 60 has a non-circular cross-section which is step tapered from a mid-section 60 region adjacent the grip receiving portion 62 to a mid-section 60 region adjacent the hosel mounting portion 64. The mid-section 60 of the shaft 58 is tapered in steps to provide greater flex of the shaft in the portion of the mid-section 60 adjacent the hosel mounting portion 64 as discussed hereinabove in conjunction FIG. 5.

Figure 7:
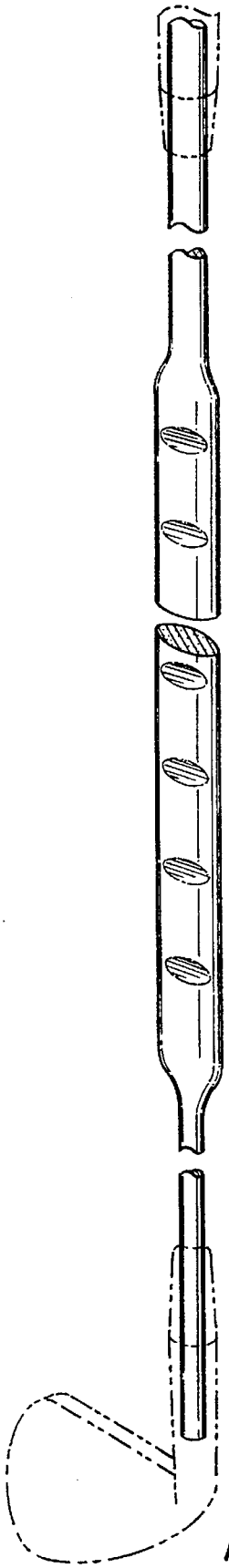
FIG. 7 is a perspective view of a golf club shaft in accordance with the invention having a generally elliptical cross section along a substantial portion of the shaft with articulations provided at selected locations of the shaft to provide greater shaft flexibility in the area of the indentation.
Figure 8:
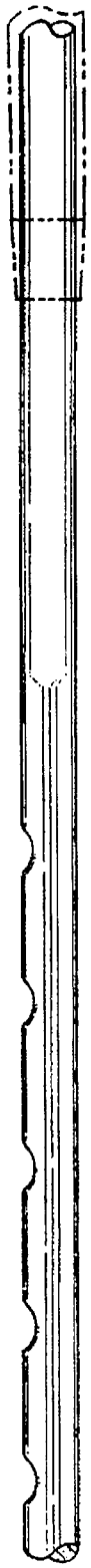
FIG. 8 is a side view of a portion of the golf club shaft of FIG. 7.

Referring to FIGS. 7 and 8, the shaft may be retrieved in one or more areas of the shaft mid-section as illustrated at 66 to obtain specific flex characteristics for the shaft.

Figure 9A:
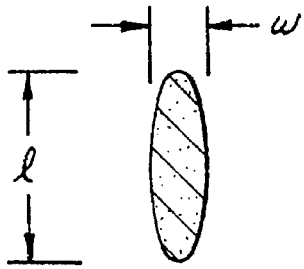
FIG. 9*a* is a purely exemplary cross section of the shaft of FIG. 9.
Figure 9:
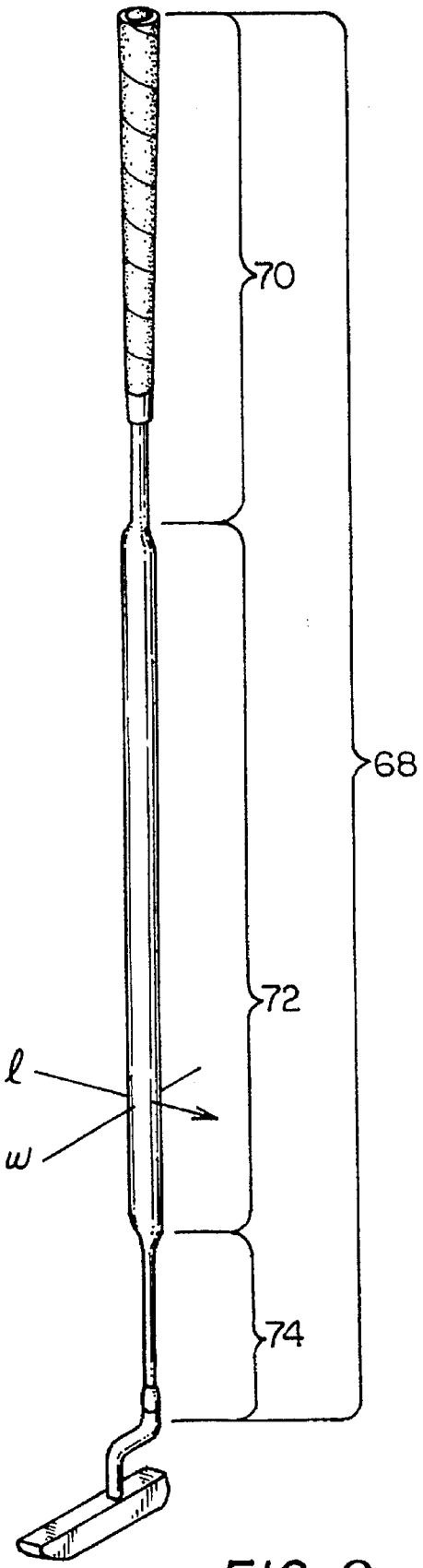
FIG. 9 is a perspective view of a putter having a shaft of non-circular cross section.

Finally, a putter is illustrated in FIG. 9. The putter has a shaft 68 which has a grip receiving portion 70, a central portion or mid-section 72 and a hosel mounting portion 74. The hosel mounting portion 74 is securely mounted to the hosel 76 of a putter head 78. The central portion is non-circular with a cross section such as illustrated in purely exemplary FIG. 9*a* in which the longest cross section dimension (in the direction of ball impact (l)) is greater than the widest cross section dimension (in the direction transverse to the direction of ball impact (w)). The central portion 72 of the shaft 68 may be tapered from a region adjacent the grip receiving portion 70 to a region adjacent the hosel mounting portion 74. Orientation of the shaft in the presently described orientation provides considerable shaft stiffness in the direction of ball impact while providing a shaft which can be fabricated of a light composite material such as a graphite composite.

It will be evident that those skilled in the art, once given the benefit of the foregoing disclosure, may make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely be the scope and spirit of the appended claims.

What is claimed is:

1. A distance golf club for hitting a golf ball in a direction of intended ball travel, comprising:

a shaft having a grip receiving portion, a central portion having a length and a hosel mounting portion, said shaft having an axis extending in the direction of said length;

a golf club head having a hosel and a ball striking portion, said hosel being mounted to said hosel mounting portion of said shaft;

said central portion of said shaft having a non-circular cross section along at least a portion of the length thereof;

said cross section of said shaft having a first dimension at the widest portion of said cross section in the direction of intended ball travel and a second dimension transverse to said direction of intended ball travel at the widest portion of said cross section, wherein said second dimension is greater than said first dimension;

wherein said shaft has a leading edge and a trailing edge and at least one indentation is provided in one of said leading and trailing edges in a plane generally perpendicular to said axis to provide greater shaft flexibility in the vicinity of said indentation.

2. A putter for striking a golf ball in a direction of intended ball travel comprising:

a shaft having a grip receiving portion, a central portion having a predetermined length and a hosel mounting portion;

a putter head having a hosel and at least one ball striking face, said hosel being adapted for mounting to said hosel mounting portion of said shaft;

said central portion of said shaft having a non-circular cross section along at least a portion of the length thereof wherein said cross section has a first dimension at the widest portion of said cross section in the direction of intended ball travel and a second dimension at the widest portion of said cross section in the direction transverse to intended ball travel and said first dimension is greater than said second dimension.

3. The putter of claim 2 wherein said central portion is tapered and the cross section of said central portion adjacent the grip receiving portion is larger than the cross section of said central portion adjacent said hosel mounting portion.

4. The putter of claim 2 further including a grip disposed on the grip receiving portion of said shaft.

* * * * *